US011173358B2

(12) United States Patent
Norimura et al.

(10) Patent No.: US 11,173,358 B2
(45) **Date of Patent: *Nov. 16, 2021**

(54) IRON GOLF CLUB HEAD

(71) Applicant: Sumitomo Rubber Industries, Ltd., Hyogo (JP)

(72) Inventors: Takahiro Norimura, Kobe (JP); Kazuhiro Hayashi, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/936,176

(22) Filed: Jul. 22, 2020

(65) Prior Publication Data

US 2020/0346078 A1 Nov. 5, 2020

Related U.S. Application Data

(63) Continuation of application No. 16/375,637, filed on Apr. 4, 2019, now Pat. No. 10,765,921, which is a (Continued)

(30) Foreign Application Priority Data

Jul. 13, 2017 (JP) ..... 2017-136691

(51) Int. Cl.
*A63B 53/04* (2015.01)
*A63B 102/32* (2015.01)
(Continued)

(52) U.S. Cl.
CPC ..... *A63B 53/047* (2013.01); *A63B 53/0475* (2013.01); *A63B 53/042* (2020.08);
(Continued)

(58) Field of Classification Search
CPC .. A63B 53/042; A63B 53/0433; A63B 53/047
(Continued)

(56) References Cited

U.S. PATENT DOCUMENTS 985,194 A * 2/1911 McLaren ..... A63B 53/0466 473/338
2,198,981 A * 4/1940 Sullivan ..... A63B 53/04 473/338
(Continued)

FOREIGN PATENT DOCUMENTS

JP 11197276 A * 7/1999
JP H11-197276 A 7/1999
(Continued)

*Primary Examiner* — Alvin A Hunter
(74) *Attorney, Agent, or Firm* — Studebaker & Brackett PC

(57) ABSTRACT

An iron golf club head comprises; a head main body including a club face provided with score lines; a weight member having a specific gravity larger than that of the head main body; and a fixing member having a specific gravity larger than that of the head main body and less than that of the weight member, and fixed to the head main body by welding so as to cover the weight member. In a forward tilting state of the club head in which the score lines are horizontal and the club face is vertical, the distance D in the perpendicular direction to the club face from the backmost position of the club head to the center of gravity of the weight member is not more than 47.3% of the maximum thickness w of the club head which is the shortest distance from the backmost position of the club head to the club face.

19 Claims, 11 Drawing Sheets

Related U.S. Application Data continuation of application No. 16/032,839, filed on Jul. 11, 2018, now Pat. No. 10,293,224.

(51) Int. Cl.
*A63B 60/02* (2015.01)
*A63B 60/54* (2015.01)

(52) U.S. Cl.
CPC ..... *A63B 53/0445* (2020.08); *A63B 60/02* (2015.10); *A63B 60/54* (2015.10); *A63B 2053/0491* (2013.01); *A63B 2102/32* (2015.10)

(58) Field of Classification Search
USPC ..... 473/324–350
See application file for complete search history.

(56) References Cited

U.S. PATENT DOCUMENTS 5,029,864 A * 7/1991 Keener ..... A63B 60/00 473/331
5,082,278 A * 1/1992 Hsien ..... A63B 60/00 473/242
6,409,612 B1 * 6/2002 Evans ..... A63B 53/047 473/324
6,592,468 B2 * 7/2003 Vincent ..... A63B 60/02 473/334
7,273,418 B2 * 9/2007 Gilbert ..... A63B 60/54 473/290
7,530,901 B2 * 5/2009 Imamoto ..... A63B 53/0466 473/334
7,871,339 B2 * 1/2011 Sanchez ..... A63B 53/04 473/335
7,976,403 B2 * 7/2011 Gilbert ..... A63B 53/0475 473/309
8,062,150 B2 * 11/2011 Gilbert ..... A63B 53/0475 473/332
8,216,088 B2 * 7/2012 Hatton ..... A63B 60/02 473/335
8,409,031 B2 * 4/2013 Stites ..... A63B 60/42 473/335
8,911,302 B1 * 12/2014 Ivanova ..... A63B 60/00 473/329
8,911,304 B1 * 12/2014 Dawson ..... A63B 60/02 473/350
9,555,299 B2 * 1/2017 Nakamura ..... A63B 53/047
9,975,016 B2 * 5/2018 Nakamura ..... A63B 53/04
10,293,224 B2 * 5/2019 Norimura ..... A63B 53/0475
10,493,338 B2 * 12/2019 Abe ..... A63B 53/02
10,765,921 B2 * 9/2020 Norimura ..... A63B 53/047
2012/0071270 A1 3/2012 Nakano

FOREIGN PATENT DOCUMENTS

JP 2003-062133 A 3/2003
JP 2003062133 A * 3/2003
JP 2012-065803 A 4/2012
JP 2017-196234 A 11/2017
JP 2017196234 A * 11/2017 ..... A63B 60/50
JP 2018-000470 A 1/2018
JP 2018000470 A * 1/2018 ..... A63B 60/02

* cited by examiner

IRON GOLF CLUB HEAD

CROSS-REFERENCE TO RELATED APPLICATIONS

This application is a continuation of U.S. patent application Ser. No. 16/375,637 filed Apr. 4, 2019, which is a Continuation of U.S. patent application Ser. No. 16/032,839 filed Jul. 11, 2018, which claims priority to Japanese Patent Application No. 2017-136691 filed Jul. 13, 2017, the entire contents of which are incorporated herein by reference.

TECHNICAL FIELD

The present invention relates to an iron golf club head comprising a head main body and a weight member.

BACKGROUND ART

The following patent document 1 discloses an iron golf club head composed of a head main body and a weight member, wherein the specific gravity of the weight member is larger than that of the head main body in order to increase the depth of the center of gravity and moments of inertia.

Patent document 1: Japanese Patent Application Publication No. 2012-65803

SUMMARY OF THE INVENTION

For such iron golf club head, when trying to increase the specific gravity of the weight member in order to increase the degree of freedom of designing the position of the center of gravity, usually, it is inevitable that the chemical components of the weight member become largely different from those of the head main body, and the weldability of the weight member with the head main body becomes liable to decrease. As a result, the degree of freedom of designing the head main body is decreased, and it becomes difficult to locate the weight member more backward of the club head.

The present invention was made in view of the circumstances described above, and a primary object thereof is to provide an iron golf club head in which, by increasing the degree of freedom of arranging the weight member, the depth of the center of gravity is increased.

According to the present invention, an iron golf club head comprises:

a head main body including a club face provided with score lines, a weight member having a specific gravity larger than that of the head main body, a fixing member having a specific gravity less than that of the weight member and larger than that of the head main body, and fixed to the head main body by welding so as to cover the weight member, wherein in a forward tilting state of the club head in which the score lines are horizontal and the club face is vertical, the distance D in the perpendicular direction to the club face from the backmost position of the club head to the center of gravity Gw of the weight member
is not more than 47.3% of
the maximum thickness w of the club head which is the shortest distance from the backmost position to the club face.

The distance D may be not more than 40.0% of the maximum thickness w of the club head.

The depth L of the center of gravity may be not less than 27.0% of the maximum thickness w of the club head.

The depth L of the center of gravity may be not less than 27.5% of the thickness wt of the club head at the position of the toe-side most end of the score lines.

The weight member may be completely covered with the fixing member, and the fixing member may form at least a part of the back face of the head main body.

The weight member may be disposed in a concave portion of the head main body.

The concave portion may be positioned in a sole forming the bottom face of the club head.

The concave portion may have a pair of slant faces arranged in a taper fashion tapering towards the bottom of the concave portion, and the weight member contacts with the slant faces but does not contact with the bottom so as to form a gap therebetween.

The position in the toe-heel direction, of the center of gravity of the weight member may be within a range between the position in the toe-heel direction, of the toe-side most end of the score lines and the position in the toe-heel direction, of the heel-side most end of the score lines.

Weldability of the head main body may be low with respect to the weight member but high with respect to the fixing member.

Therefore, in the iron golf club head according to the present invention, even if weldability of the weight member with the head main body is not good, as the weight member is covered with the fixing member welded to the head main body, the weight member is secured to the head main body. As a result, the degree of freedom of arranging the weight member is increased, and it becomes possible to arrange the position of the center of gravity of the weight member near the backmost position of the club head. Further, as the fixing member has a larger specific gravity than the head main body, the mass of the fixing member can be used to designing the position of the center of gravity of the club head. Thereby, according to the present invention, it is possible to provide an iron golf club head increased in the depth of the center of gravity.

DESCRIPTION OF THE PREFERRED EMBODIMENTS

Embodiments of present invention will now be described in detail in conjunction with accompanying drawings.

In FIGS. 1-4, 7 and 9, the golf club head 1 is in its forward tilting state. In FIG. 8, the golf club head 1 is in its standard state.

Figure 11:
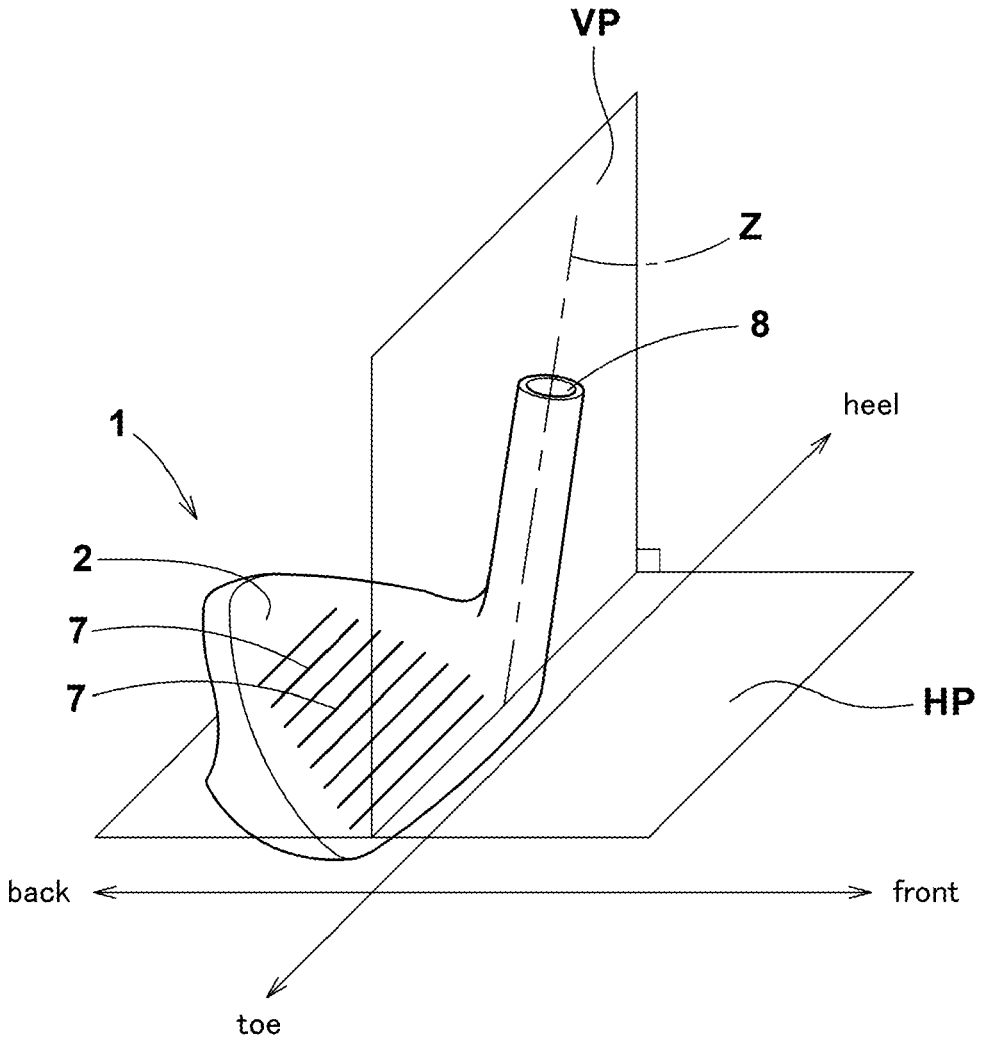
FIG. 11 is a schematic perspective view of a golf club head for explaining the standard state of the golf club head.

In this specification, the "standard state" of an iron golf club head refers to such a state that the club head 1 is set on a horizontal plane HP so that score lines (grooves) 7 formed in the club face 2 become parallel with the horizontal plane HP, and the central axis z of the shaft inserting hole 8 of the iron golf club head 1 lies within a vertical plane VP perpendicular to the horizontal plane HP as shown in FIG. 11. In the standard state, the score lines 7 are parallel with the vertical plane VP as well as the horizontal plane HP.

In this application including the description and claims, dimensions, positions, directions and the like relating to the club head refer to those under the standard state of the club head unless otherwise noted.

"Toe-heel direction" is a direction parallel with the horizontal plane HP and the vertical plane VP, namely, parallel with the score lines 7.

"up-down direction" is a direction perpendicular to the horizontal plane HP.

"Front-back direction" is a direction parallel with the horizontal plane HP and perpendicular to the vertical plane VP.

In this specification, the "forward tilting state" of an iron golf club head refers to such a state that the golf club head 1 under the standard state is rotated around a horizontal axis parallel with the toe-heel direction so that the club face 2 becomes perpendicular to the horizontal plane HP.

As shown in FIGS. 1 to 6, the golf club head 1 in this embodiment has a shape which is typical of the iron golf club heads, and comprises a club face 2, a top 3, a sole 4, a toe 5 and a hosel 6.

The club face 2 is a substantially flat surface for hitting a golf ball. The club face 2 is provided with score lines (grooves) 7 extending in the toe-heel direction of the club head in order to increase the friction with the ball.

The top 3 is an upper surface of the club head extending backward of the club head from the upper edge 2 of the club face 2.

The sole 4 is a bottom surface of the club head extending backward of the club head from the lower edge of the club face 2.

The toe 5 is a part being most distant from the hosel 6 and smoothly connecting between the top 3 and the sole 4.

The hosel 6 is a part provided with a shaft inserting hole 8 into which a clubshaft is inserted, and formed in a tubular shape, for example.

The center line z of the club shaft inserting hole 8 substantially coincides with the central axis of the clubshaft inserted therein.

The golf club head 1 in this embodiment is composed of a head main body 10 and a weight member 20 and a fixing member 30.

The head main body 10 is a component constituting a major part of the golf club head 1.

The head main body 10 in this embodiment comprises the club face 2 provided with the score lines 7, the top 3, the sole 4, the toe 5 and the hosel 6.

The head main body 10 is, for example, made of a metal material or metal materials.

Figure 5:
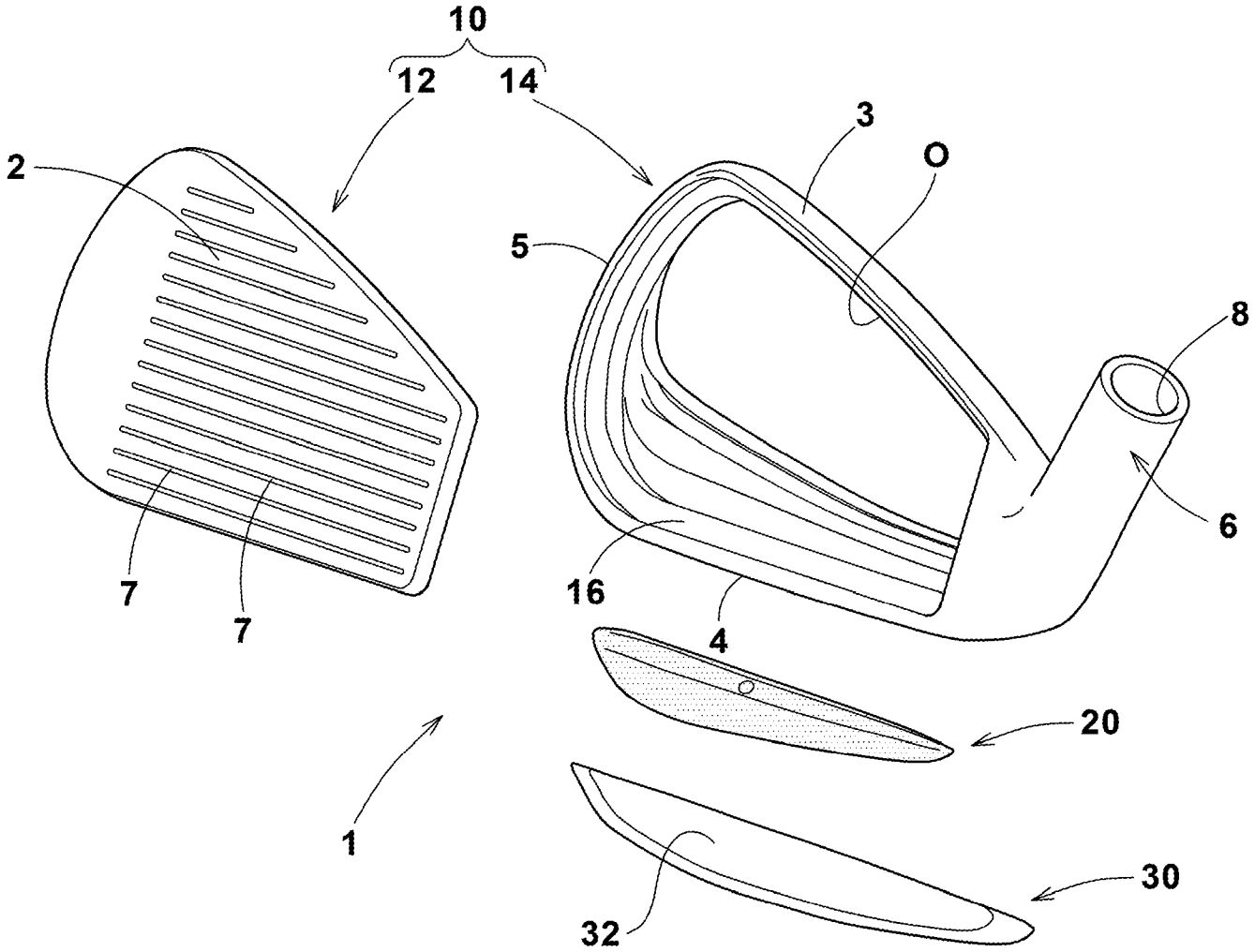
FIG. 5 is an exploded perspective view of the golf club head viewed from the front of the club head showing the structure in this embodiment.

Preferably, the head main body 10 is composed of a face plate 12 and a face plate receiving part 14 as shown in FIG. 5.

In this embodiment, the face plate 12 is made of a metal material, and the face plate receiving part 14 is made of a metal material different from the face plate 12.

Preferably, the metal material of the face plate 12 has a specific gravity lowest in the metal materials forming the golf club head 1 in order to set the position of the center of gravity G more backward of the club head.

For example, the face plate 12 is preferably made of a titanium alloy having a specific gravity of 4.5 or less and a higher specific strength.

The face plate receiving part 14 in this example is provided with a through hole penetrating therethough in the front-back direction of the club head to have a front opening O, and surround by the top 3, the sole 4 and the toe 5. Further, the face plate receiving part 14 integrally includes the hosel 6.

The face plate receiving part 14 comprises a face plate mounting portion 16, which is formed around the opening O, and to which the peripheral edge portion of the face plate 12 is fixed.

By fixing the face plate 12 to the face plate mounting portion 16, the front opening O is closed by the face plate.

The face plate 12 and the face plate receiving part 14 can be united with each other by using various techniques, for example, welding, brazing, adhesive agent, caulking and the like.

Preferably, the face plate receiving part 14 is made of an iron base alloy having higher strength and good workability such as stainless and carbon steel.

Preferably, the iron base alloy has a specific gravity of not less than 7.0, more preferably not less than 7.5.

Thus, it is possible to locate the center of gravity G more backward of the club head.

As another example, the head main body 10 can be made of a single kind of material or three or more kinds of materials.

In the case of the head main body 10 made of a single kind of material, a typical example is the head main body 10 having one piece structure without the separate face plate 12 and face plate receiving part 14.

Another example is the head main body 10 having two piece structure comprising the separate face plate 12 and face plate receiving part 14 both made of an identical material and united with each other.

In the case of the head main body 10 made from three or more kinds of materials, the face plate receiving part 14 is composed of two or more separate parts, and the face plate 12 is fixed thereto.

Figure 4C:
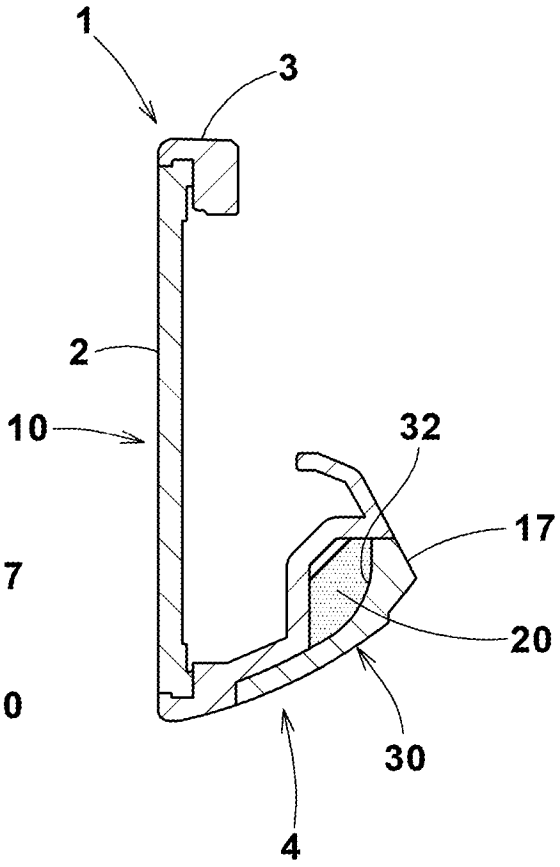
FIGS. 4(A), 4(B) and 4(C) are cross sectional views of the golf club head taken along line A-A, line B-B and line C-C of FIG. 2.
Figure 4B:
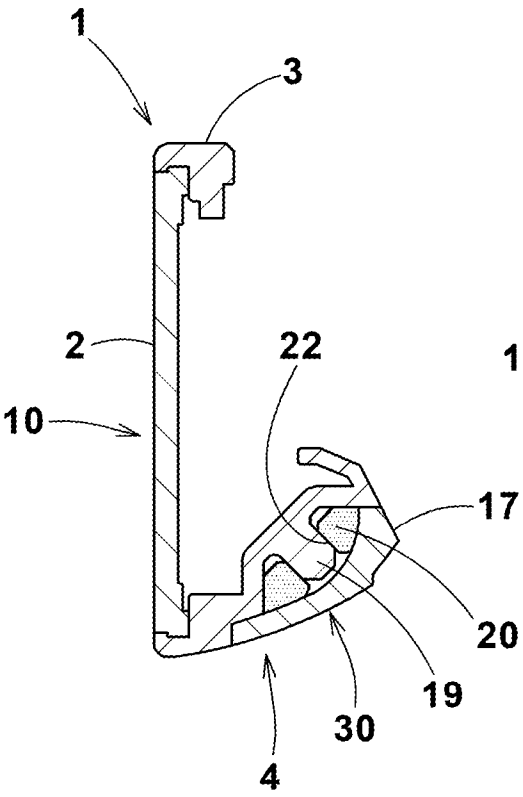
Figure 4A:
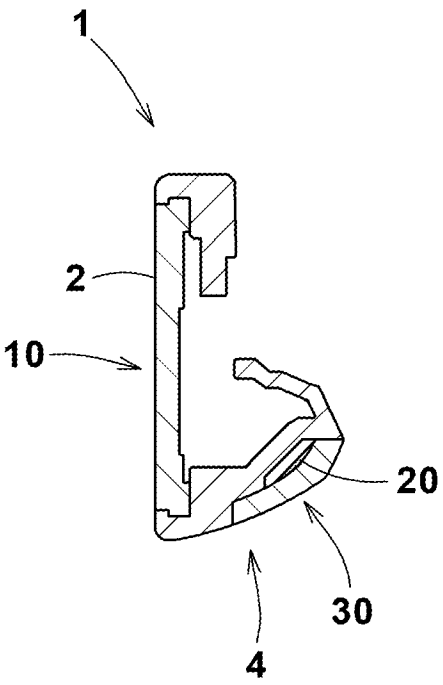
Figure 6:
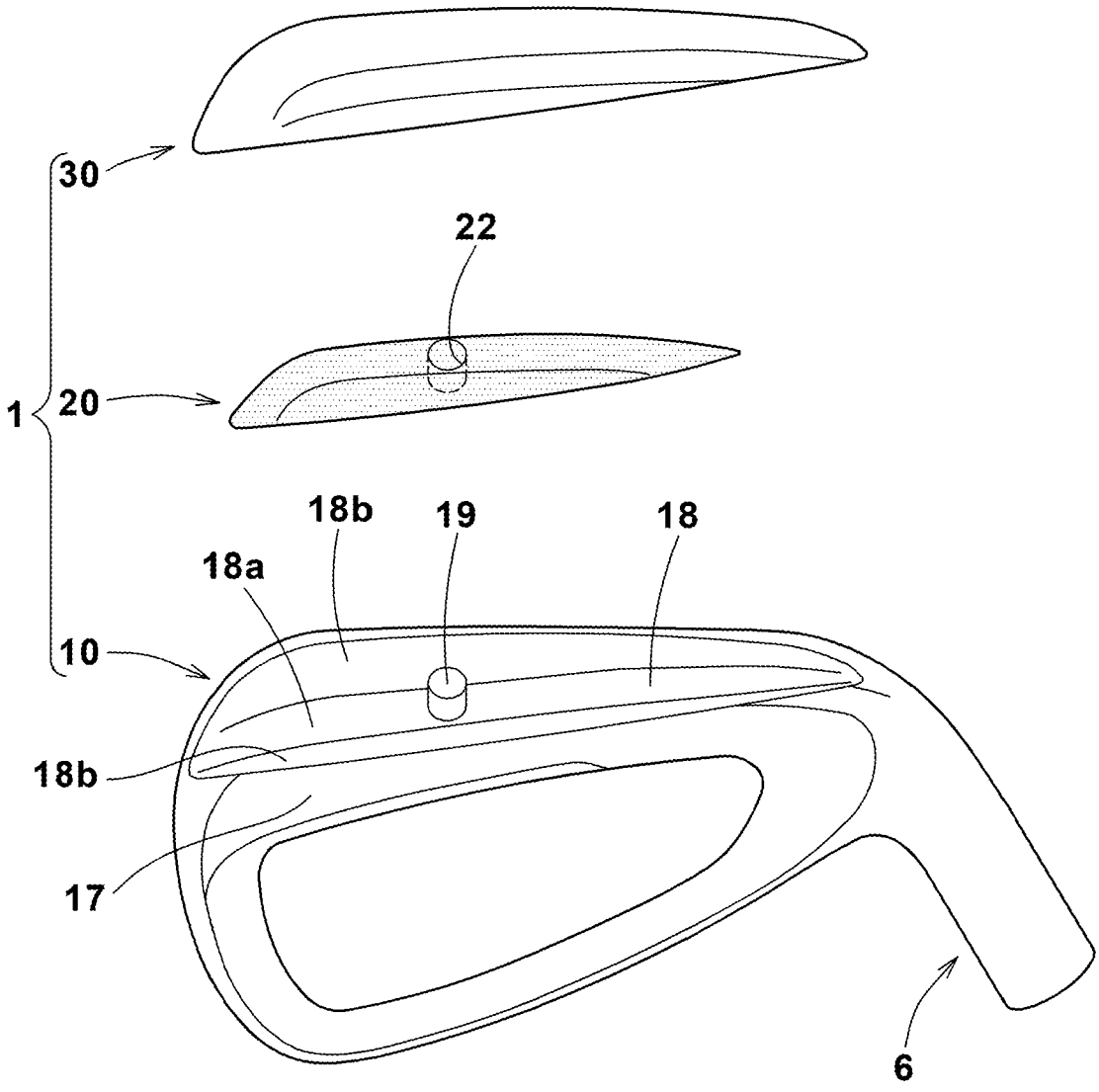
FIG. 6 is an exploded perspective view of the golf club head viewed from the rear of the club head.

For example, as shown in FIG. 4 and FIG. 6, the head main body 10 is provided with a concave portion 18 depressed from a virtual surface corresponding to the outer surface of the club head.

In this embodiment, the undermentioned weight member 20 and fixing member 30 are disposed in the concave portion 18, and the outer surface of the club head is formed.

In this embodiment, the concave portion 18 is formed in the form of a groove extending long in the toe-heel direction in a sole 4 side, specifically, in the sole of the face plate receiving part 14.

The weight member 20 is made of a metal material having a specific gravity larger than a specific gravity of the club head main body 10.

Incidentally, the specific gravity of the club head main body 10 is determined from the mass and volume of the club head main body 10.

In this embodiment, in order to shift the center of gravity G of the club head downward and backward of the club head, the weight member 20 is disposed in a sole side and rear side of the club head.

As shown in FIG. 5 and FIG. 6, the weight member 20 in this example extends long in the toe-heel direction.

Figure 3:
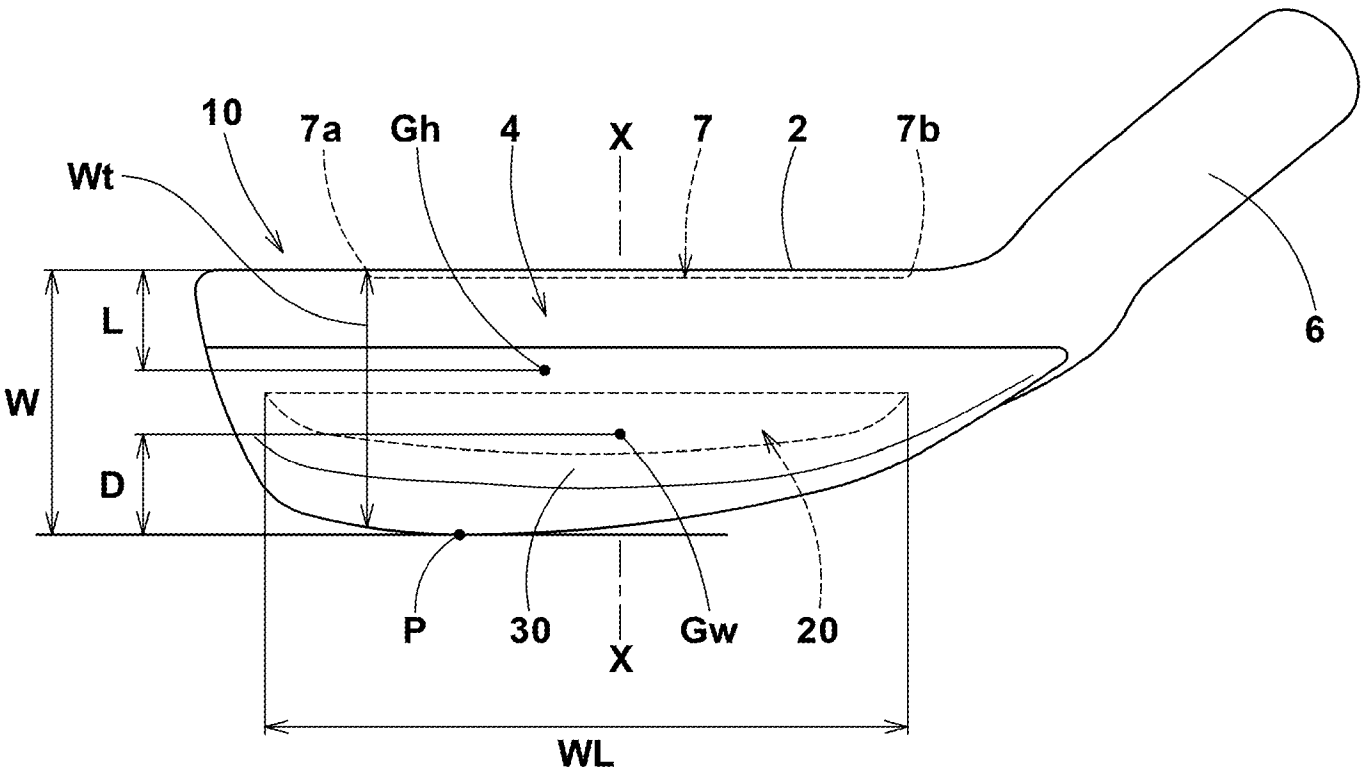
FIG. 3 is a bottom view of the golf club head.

Specifically, the length WL in the toe-heel direction of the weight member 20 is set to be not less than the distance in the toe-heel direction from the toe-side most end 7*a* to the heel-side most end 7*b* of the score lines 7 as shown in FIG. 3.

The cross-sectional area measured perpendicularly to the toe-heel direction of the weight member 20 is gradually decreased toward both sides in the toe-heel direction.

In view of easiness of adjusting the position of the center of gravity G of the club head and easiness of swinging the golf club, it is preferred that the mass of the weight member 20 is set in a range from about 7% to 12% of the mass of the club head.

The weight member 20 can be made of a tungsten-nickel-iron alloy comprising W, Ni and Fe.

The specific gravity of the weight member 20 is not essential, but preferably 10.0 or more, more preferably 12.0 or more, and preferably 18.5 or less.

In order to reduce the size of the weight member to improve the production efficiency and increase the flexibility of designing the head, a higher specific gravity is preferred.

The tungsten-nickel-iron alloy achieves a high specific gravity by increasing the tungsten content relatively to the iron content.

When the tungsten content of the alloy is increased, the weldability with the iron base alloy such as soft iron, stainless and carbon steel, namely, the head main body 10 is decreased.

This means that it is difficult to strongly fix the weight member 20 to the head main body 10 by using a simple welding technique.

The weight member 20 is disposed within the concave portion 18. Therefore, the volume of the weight member 20 is set to be smaller than the volume of the concave portion 18. The weight member 20 comes into contact with at least part of the surface of the concave portion 18 as explained hereunder.

Figure 1:
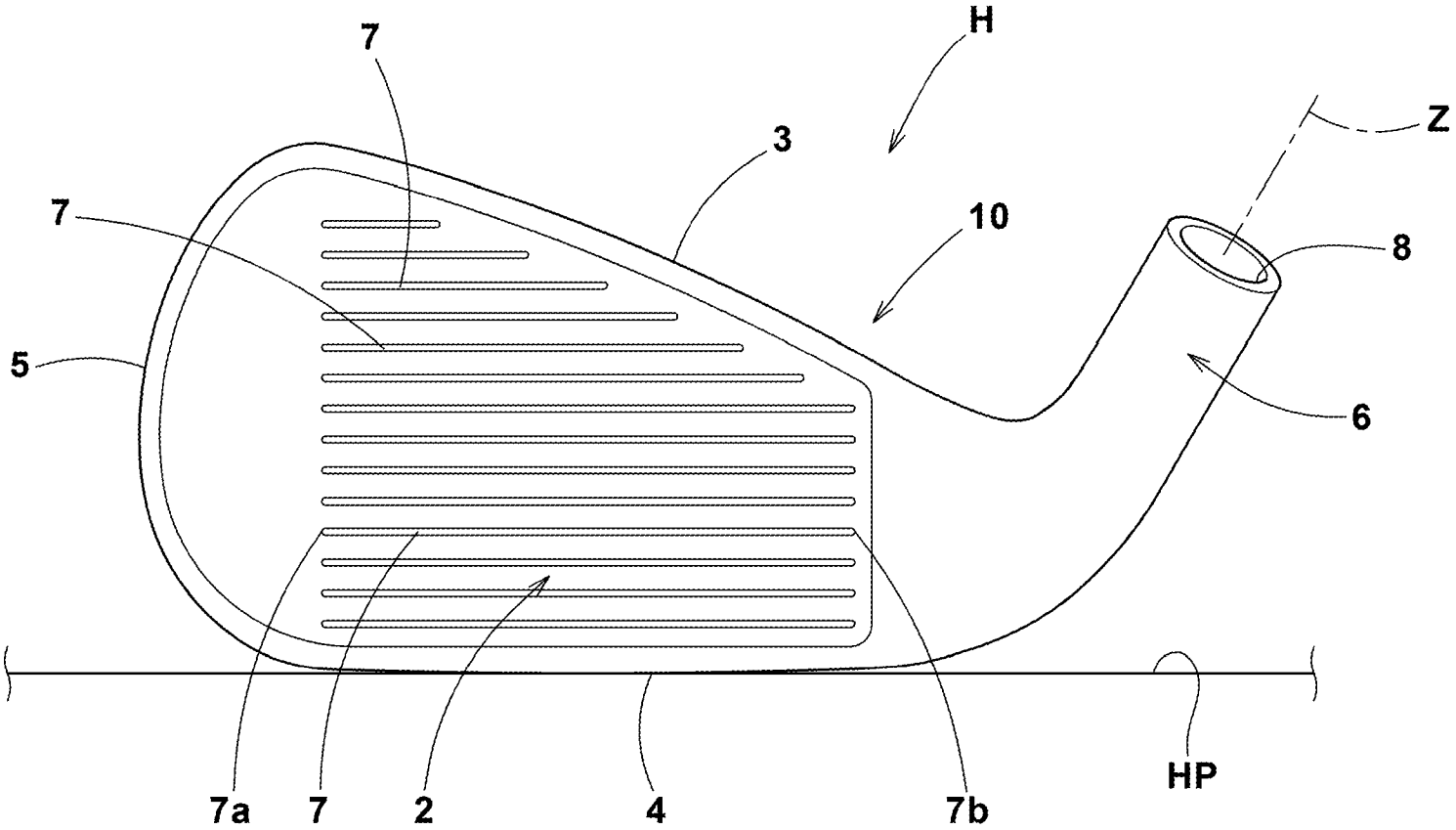
FIG. 1 is a front view a golf club head as an embodiment of the present invention.
Figure 2:
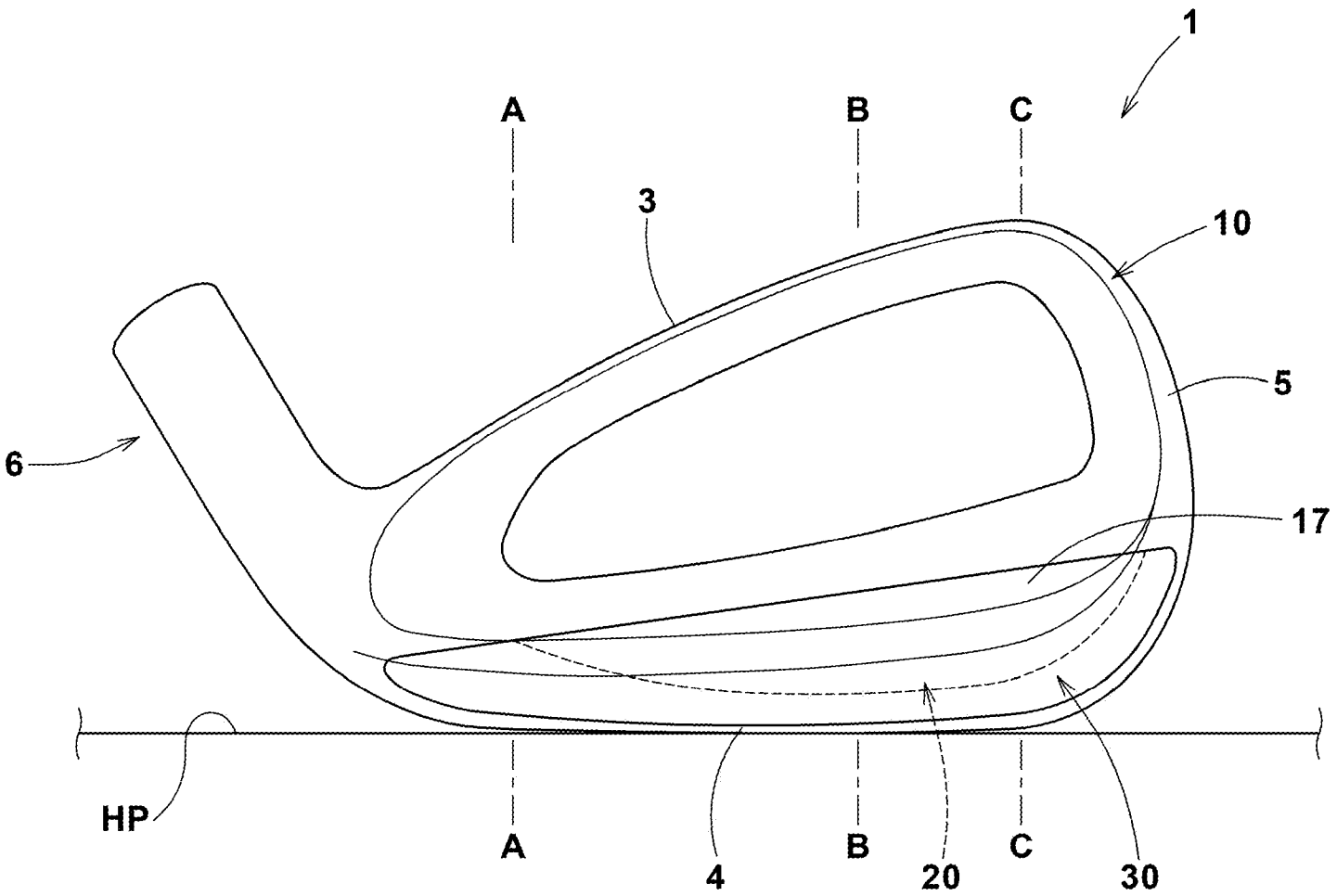
FIG. 2 is a rear view of the golf club head.

The fixing member 30 is fixed to the head main body 10 and covers over the weight member 20 as shown in FIGS. 2-4. The fixing member 30 is made of a metal material capable of being fixed to the head main body 10 by welding. Preferably, the specific gravity of the metal material of the fixing member 30 is more than the specific gravity of the club head main body 10, and less than the specific gravity of the weight member 20.

The mass of the fixing member 30 can be used to design the position of the center of gravity G of the club head.

Metal materials suitable for the fixing member 30 may include a tungsten-nickel-iron alloy comprising w, Ni and Fe which is decreased in the tungsten content as compared with the tungsten-nickel-iron alloy of the weight member 20, while having a higher specific gravity than the head main body 10 and having a higher weldability (joint strength) with the head main body 10 than the weight member 20.

The specific gravity of such fixing member 30 is preferably set in a range from 8.0 to 10.0.

In this example, the fixing member 30 completely covers over the weight member 20 and welded to the head main body 10 as shown in FIGS. 2-4. Thus, it is possible to secure the weight member 20 to the head main body 10 even if the weldability of the weight member 20 with the head main body 10 is low.

In order to increase the joint strength, the fixing member 30 is preferably welded to the head main body 10 along the entire peripheral edge of the fixing member 30.

In order to prevent movements and backlash of the weight member 20, it is preferred that the inside surface 32 of the fixing member 30 at least partially contacts with and presses the outside surface of the weight member 20.

The fixing member 30 in this example forms a part of the back face 17. Thereby, owing to the mass of the fixing member 30, the center of gravity G of the club head can be positioned more backward to increase the depth GL of the center of gravity G. The fixing member 30 may form at least part of the sole 4.

In this arrangement, owing to the mass of the fixing member 30, the position of the center of gravity G of the club head can be further lowered.

Here, the back face 17 means a surface of the iron golf club head 1 which is visible in the rear view of the iron golf club head 1 under the above-mentioned forward tilting state.

The fixing member 30 in this example completely covers over the weight member 20. But, as another example, the fixing member 30 may cover a part of the weight member 20 as far as the weight member 20 can be secured between the fixing member 30 and the head main body 10.

Figure 7:
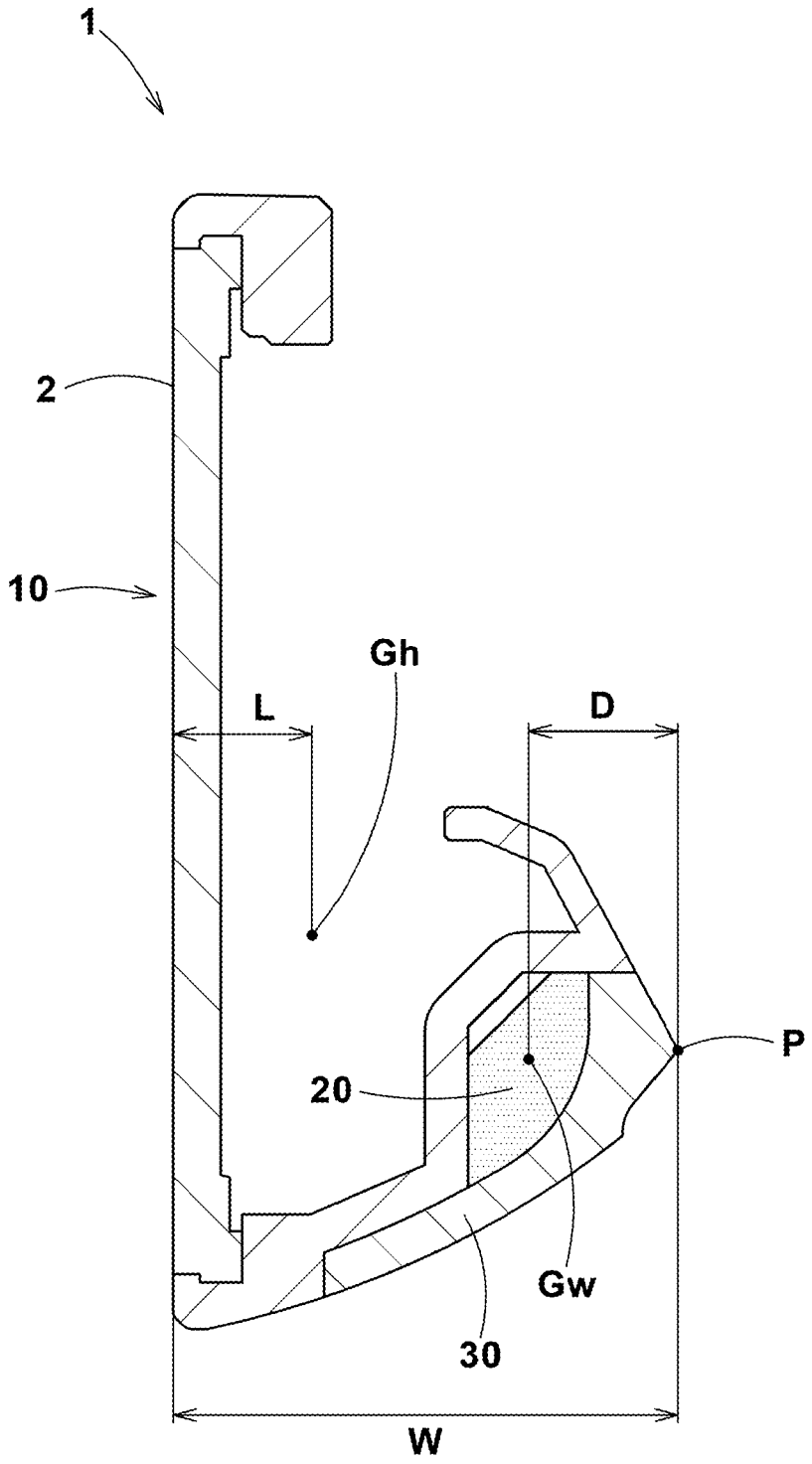
FIG. 7 and FIG. 8 are cross sectional views taken along line x-x of FIG. 3.
Figure 8:
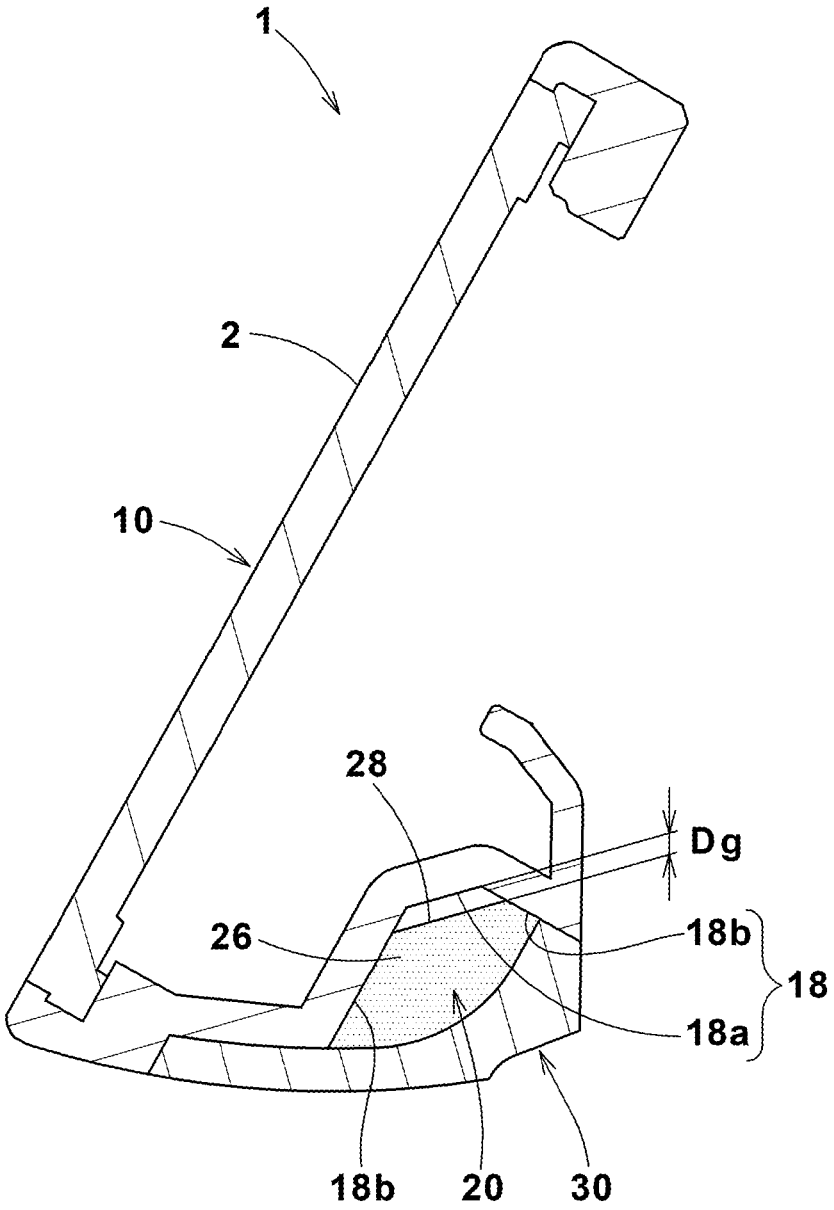

In the golf club head 1 in the forward tilting state as shown in FIG. 3 and FIG. 7, the distance D in the perpendicular direction to the club face 2 from the backmost position P of the club head to the center of gravity Gw of the weight member 20 is set to be not more than 47.3% of the maximum thickness w of the club head.

As the fixing member 30 covers the weight member 20 which can not be welded to the head main body 10, the weight member 20 can be secured to the head main body 10. Thus, the degree of freedom of arranging the weight member 20 is increased, and it becomes possible to arrange the position of the center of gravity of the weight member 20 near the backmost position of the club head.

Further, in the golf club head 1 in this embodiment, as the position of the center of gravity Gw of the weight member 20 whose specific gravity is high, is arranged in a specific range from the backmost position P of the club head, it is possible to provide a larger depth L of the center of gravity G. Therefore, the golf club head 1 in this embodiment can increase the launch angle of the ball, and can provide a larger vertical moment of inertia.

In this embodiment, only one weight member 20 is disposed in the club head. Accordingly, the center of gravity is that of the weight member 20.

As another example, two or more separate weight members may be disposed in the club head. For example, two weight members may be disposed in a toe side and a heel side of the club head. In this case, taking all the weight members as a single mass, the center of gravity G of the weight member 20 is defined by that of the single mass The maximum thickness w of the club head occurs at a position toward the toe in the club face 2, for example, near the toe-side most end 7*a* of the score lines 7.

The maximum thickness w of the club head is the shortest distance between the club face 2 and the backmost position P of the club head in the forward tilting state.

The depth L of the center of gravity G is the shortest distance from the center of gravity G of the club head to the club face 2.

If the distance D exceeds 47.3% of the maximum thickness w of the club head, there is a tendency that the depth L of the center of gravity G becomes small.

Preferably, the distance D is not more than 40.0%, more preferably not more than 38.0% of the maximum thickness w of the club head.

In regard to the position in the toe-heel direction, it is preferable that the center of gravity Gw of the weight member 20 is positioned within a range in the toe-heel direction between the toe-side most end 7*a* and the heel-side most end 7*b* of the score lines 7 as shown in FIG. 3 in order to shift the center of gravity G of the club head more backward of the club head within this range in the toe-heel direction.

It is preferable that, by arranging the center of gravity Gw of the weight member 20 in the above-mentioned range, the depth L of the center of gravity G is set to be not less than 27.0% of the maximum thickness w of the club head. In this arrangement, it is preferable that the depth L of the center of gravity G is set to be not less than 27.5% of the club head thickness wt at the position of the toe-side most end 7*a* of the score lines 7.

It is not essential, but preferable that the maximum thickness w of the club head is set in a range from 15 to 30 mm.

(Design 1)

As shown in FIG. 8, the concave portion 18 of the club head main body 10 may comprises a bottom face 18*a* denting from the outer surface of the club head, and a pair of slant faces 18*b* arranged in a taper fashion tapering towards the bottom face. Preferably, one of the slant faces 18*b* is parallel with the club face 2, and the other is orthogonal to the club face 2. The bottom face 18*a* is a flat face and intersects with each of the slant faces 18*b* at an obtuse angle, for example, about 135 degrees.

Meanwhile, the weight member 20 is provided with a tapered part 26 fitted between a pair of the slant faces 18*b*, and the surfaces of the tapered part 26 at least partially contact with the respective slant faces 18*b*. However, a truncated face 28 formed at the tip end of the tapered part 26 does not contact with the bottom face 18*a* of the concave portion 18 and a gap Dg is formed. Preferably, the gap is 0.5 mm or more. Thereby, the slant faces 18*b* fix the position of the weight member 20 and prevent movements (in the toe-heel direction, front-back direction and upward direction) of the weight member 20 within the club head, therefore, generation of abnormal noise when hitting the ball due to backlash or vibrations of the weight member 20 within the club head can be prevented.

Incidentally, the tapered part 26 does not require extremely high working accuracy, thereby, the production efficiency may be improved.

(Design 2)

Figure 9:
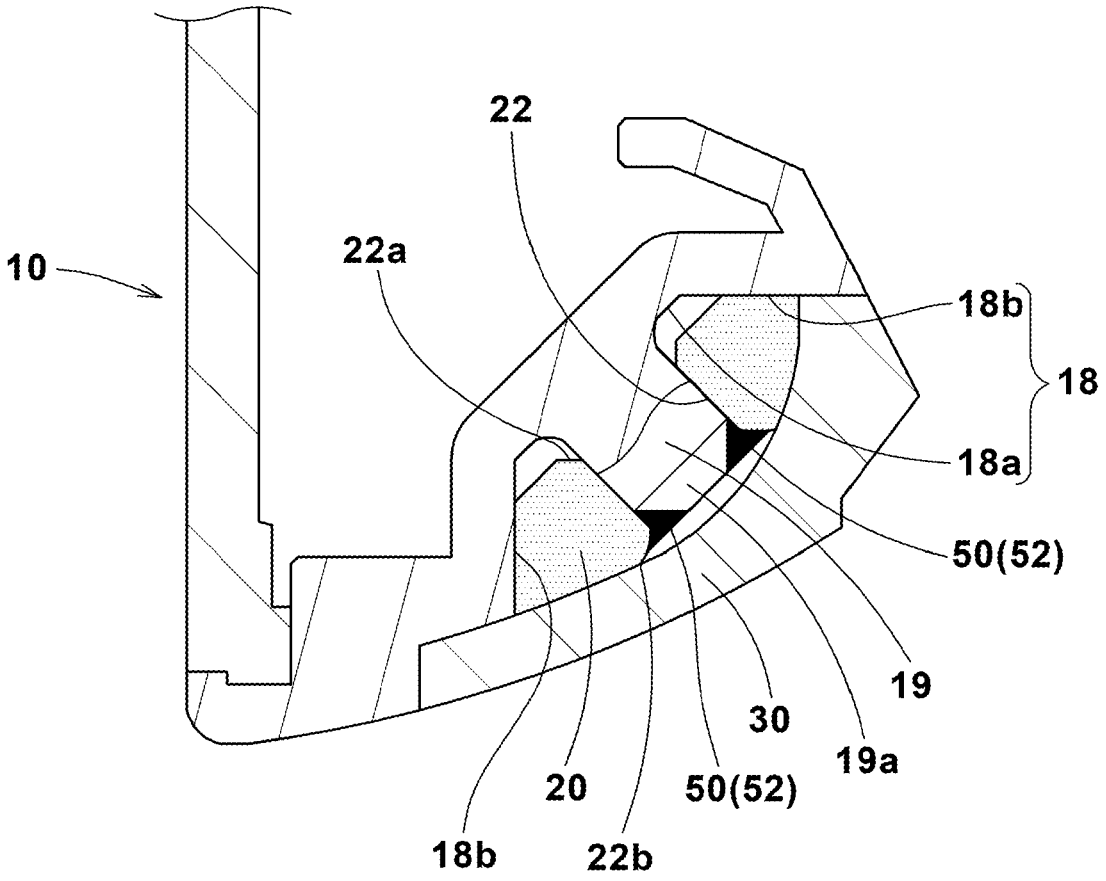
FIG. 9 is a closeup of a part of FIG. 4(B).

As shown in FIG. 4(B) and FIG. 9, the concave portion 18 of the club head main body 10 may be provided with at least one projecting part 19 protruding toward the outside of the club head in addition to or instead of the above desirable Design 1.

The projecting part 19 in this example is formed in the bottom face 18*a* of the concave portion 18.

The projecting part 19 in this example is substantially column-shaped. But, the shape of the projecting part 19 is not to be limited thereto.

In this example, only one projecting part 19 is provided. But, two or more projecting parts may be provided in the concave portion 18.

Corresponding to the position of the projecting part 19, the weight member 20 is provided with a through-hole 22 into which the projecting part 19 is fitted. Thereby, backlash and vibrations can be prevented. Thus, by combining the Design 2 with the above described Design 1, the vibrations and backlash and the resulting abnormal noise can be effectively prevented.

As shown in FIG. 3, the through-hole 22 is preferably disposed in a central portion in the length direction of the weight member 20 in order to effectively prevent backlash and vibrations of the weight member 20.

Here, the length direction of the weight member 20 means a direction in which the maximum length WL of the weight member 20 occurs. In this example, the length direction is the toe-heel direction of the club head.

The central portion of the length direction means a portion ranging 20% of the maximum length WL toward both sides in the length direction from the midpoint of the maximum length WL in the length direction.

(Design 3)

On the basis of the above-described Design 2, a securing part 50 securing the weight member 20 to the head main body 10 may be further provided between the through-hole 22 and the projecting part 19 as shown in FIG. 11.

It is preferable that the securing part 50 fills a possible gap between the through-hole 22 and the projecting part 19 to prevent their relative movements by the friction and/or mechanical engagement between them.

It is not essential, but preferable that the securing part 50 is formed from a metal material 52 welded to the tip end of the projecting part 19 like a weld bead.

For example, such securing part 50 is formed from a metal material 52 melted and penetrated into the gap and then hardened in a state filling the gap and fused with the metal material of the projecting part 19, namely, that of the club head main body 10 in this example.

Therefore, even if the securing part 50 is not fused with or welded to the weight member 20, as the space between the through-hole 22 and the projecting part 19 decreases or disappears, the adhesion between the securing part 50 and the weight member 20 is improved.

This effectively prevent vibrations of the weight member 20 relative to the head main body 10, namely, vibrations in perpendicular directions to the protruding direction of the projecting part 19.

In order that the securing part 50 can firmly and stably fix the weight member 20 by increasing its bonding strength to the projecting part 19, the tip end of the projecting part 19 in this example is provided with a tapered portion 19*a* so that an annular space (gap) increasing towards the outer surface of the club head is formed between the tapered portion 19*a* and the through-hole 22.

The melted metal material 52 filling the annular space is increased in the volume and the contact surface with the projecting part 19, therefore, the bonding strength and the strength itself are increased.

In this example, the metal material 52 is given as a separate material from the projecting part 19 and the weight member 20 and fused with the projecting part 19. But, it may be also possible to use a portion of the projecting part 19 melted as the melted metal material 52.

In any case, the metal material 52 hardened around the projecting part 19 forms the securing part 50 capable of firmly and stably fixing the weight member 20.

The through-hole 22 of the weight member 20 has an inside opening 22*a* toward the inside of the club head and an outside opening 22*b* toward the outside of the club head, and the outside opening 22*b* preferably has a larger opening area than the inside opening 22*a*.

More specifically, the through-hole 22 in this example comprises a tapered portion in which the area of the cross section of the through-hole 22 perpendicular to its protruding direction is gradually decreased from the outside opening 22*b* toward the inside opening 22*a*.

This also gradually increases the space between the through-hole 22 and the projecting part 19 for forming the securing part 50, toward the outside of the club head.

Such space helps the melted metal material 52 poured therein to penetrate deep into the space, for example, near to the root of the projecting part 19.

Thus, the securing of the weight member 20 from the outer side of the club head by the metal material 52 is enhanced.

As a result, movements of the weight member 20 in the protruding direction of the projecting part 19 can be mechanically effectively prevented even if the weight member 20 is not welded, and abnormal noise due to such movements can be completely prevented.

Figure 10:
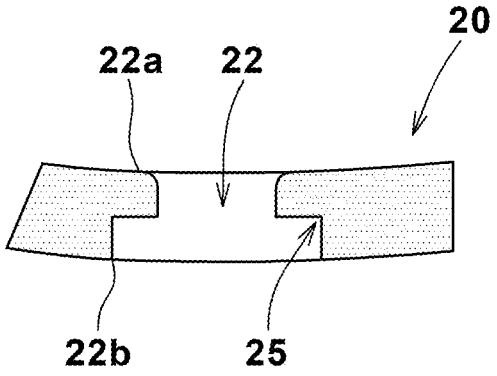
FIG. 10 is a cross sectional view of a modified example of the weight member taken at a position corresponding to line B-B in FIG. 2.

FIG. 10 shows another example of the through-hole 22 whose outside opening 22*b* is increased in the opening area. In this example, the through-hole 22 comprises an enlarged portion 25 on the outside opening 22*b* side in which the area of the cross section of the through-hole 22 is increased stepwise from its immediately inside portion.

It is preferable to employ the enlarged portion 25 in combination with the projecting part 19 with the tapered portion 19*a*. But, it is also possible to employ the enlarged portion 25 in combination with the projecting part 19 without the tapered portion 19*a*.

Aside from the above-described metal material 52, a wedge member press-fitted into the space between the projecting part 19 and the through-hole 22 such as a ring-shaped elastic body, a ring of an elastomer and a ring of a metal may be used as the securing part 50.

In either case, the securing part 50 is invisibly covered over with the fixing member 30, therefore the securing part 50 does not negatively affect the exterior appearance of the club head.

While detailed description has been made of a preferable embodiment and modifications of the present invention, the present invention can be embodied in various forms without being limited to the illustrated embodiment.

Comparison Test

Based on the structure described with reference to FIGS. 1 to 6, iron golf club heads having specifications shown in Table 1 were experimentally manufactured, and measured for the depth of the center of gravity G and the like.

The results are shown in Table 1. As shown, the iron golf club heads according to the present invention were increased in the depth of the center of gravity G as compared with the comparative club head (Ref.) whose D/w was more than 47.3%.

TABLE 1

| | Embodiment 1 | Embodiment 2 | Embodiment 3 |
|---|---|---|---|
| mass of club head (g) | 244.0 | 250.0 | 256.0 |
| maximum head thickness W (mm) | 24.8 | 24.4 | 23.8 |
| head thickness Wt at toe-side most end of score lines (mm) | 24.7 | 24.3 | 23.6 |
| mass of weight member (g) | 30.0 | 30.0 | 30.0 |
| distance D (mm) | 9.3 | 8.9 | 8.2 |
| position of center of gravity of weight member (*1) | −6.5 | −9.0 | −14.0 |
| D/W | 37.7% | 36.5% | 34.5% |
| D/Wt | 37.8% | 36.7% | 34.8% |
| depth L of center of gravity (mm) | 7.1 | 6.9 | 6.6 |
| L/W | 28.4% | 28.2% | 27.7% |
| L/Wt | 28.5% | 28.4% | 27.9% |

| | Embodiment 4 | Embodiment 5 | Embodiment 6 | Ref. |
|---|---|---|---|---|
| mass of club head (g) | 262.0 | 244.0 | 262.0 | 262.0 |
| maximum head thickness W (mm) | 23.1 | 24.0 | 23.0 | 22.8 |
| head thickness Wt at toe-side most end of score lines (mm) | 22.9 | 23.9 | 22.7 | 22.6 |
| mass of weight member (g) | 30.0 | 30.0 | 30.0 | 30.0 |
| distance D (mm) | 8.0 | 11.4 | 9.6 | 11.3 |
| position of center of gravity of weight member (*1) | −14.5 | −6.8 | −13.6 | −12.8 |
| D/W | 34.7% | 47.3% | 41.9% | 49.6% |
| D/Wt | 35.1% | 47.5% | 42.4% | 50.1% |
| depth L of center of gravity (mm) | 6.3 | 6.2 | 5.8 | 5.3 |
| L/W | 27.3% | 26.0% | 25.4% | 23.3% |
| L/Wt | 27.5% | 25.9% | 25.5% | 23.3% |

(*1) Distance from the center of the club face.

Minus sign means the position being on the toe-side of the center of the club face.

REFERENCE SIGNS LIST

1 golf club head
7 score line
10 head main body
20 weight member
30 fixing member

The invention claimed is:

1. An iron-type golf club head comprising:

a head main body including a striking face comprising scorelines, the main body comprising a main body specific gravity;

a weight member having a weight member specific gravity that is larger than the main body specific gravity; and a fixing member having a fixing member specific gravity less than the weight member specific gravity, the fixing member being fixed to the head main body by welding so as to cover the weight member, wherein weldability of the head main body with respect to the weight member is lower than weldability of the head main body with respect to the fixing member, wherein the weight member further comprises a weight member center of gravity; and measured in a direction perpendicular to the striking face, the club head further comprises:

a backmost location;

a maximum thickness W being the shortest distance between the striking face and the backmost location; and a distance D, from the backmost location to the weight member center of gravity, that is not more than 47.3% of the maximum thickness W of the club head.

2. The iron-type golf club head of claim 1, wherein the fixing member specific gravity is larger than the main body specific gravity.

3. The iron-type golf club head according to claim 1, wherein the distance D is not more than 40.0% of the maximum thickness W of the club head.

4. The iron-type golf club head according to claim 1, wherein the weight member is completely covered with the fixing member and the fixing member forms at least a part of a back face of the head main body.

5. The iron-type golf club head according to claim 1, wherein the weight member is disposed in a recess of the head main body.

6. The iron-type golf club head according to claim 5, wherein the recess is positioned in a sole of the club head forming a bottom face of the club head.

7. The iron-type golf club head according to claim 5, wherein the recess comprises a pair of slant faces that taper toward a bottom surface of the recess, and the weight member contacts the slant faces but does not contact the bottom surface so as to form a gap therebetween.

8. The iron-type golf club head according to claim 1, wherein:

the scorelines comprise a toe-most end and a heel-most end; and the weight member further comprises a center of gravity that is located, in the heel-to-toe direction, between the heel-most end and the toe-most end of the scorelines.

9. The iron-type golf club head according to claim 1, further comprising a total head mass, wherein the weight member further comprises a weight member mass that is between 7% and 12% of the total head mass.

10. An iron-type golf club head comprising:

a head main body including a striking face comprising scorelines, the main body comprising a main body specific gravity;

a weight member having a weight member specific gravity that is larger than the main body specific gravity; and a fixing member having a fixing member specific gravity less than the weight member specific gravity, the fixing member being fixed to the head main body by welding so as to cover the weight member, wherein weldability of the head main body with respect to the weight member is lower than weldability of the head main body with respect to the fixing member;

a club head center of gravity;

a backmost location measured in a direction perpendicular to the striking face;

a maximum thickness W being the shortest distance between the striking face and the backmost location; and a depth L of the club head center of gravity measured from and perpendicular to the striking face, the depth L being no less than 27.0% of the maximum thickness W of the club head.

11. The iron-type golf club head according to claim 10, wherein:

the scorelines comprise a heel-most end and a toe-most end; and the depth L is no less than 27.5% of a thickness wt of the club head measured at a position of the toe-most end of the scorelines.

12. The iron-type golf club head of claim 10, wherein the fixing member specific gravity is larger than the main body specific gravity.

13. The iron-type golf club head of claim 10, wherein:

the weight member further comprises a weight member center of gravity; and a distance D, measured from the backmost location to the weight member center of gravity in a direction perpendicular to the striking face, is not more than 47.3% of the maximum thickness W of the club head.

14. The iron-type golf club head according to claim 10, wherein the weight member is completely covered with the fixing member and the fixing member forms at least a part of a back face of the head main body.

15. The iron-type golf club head according to claim 10, wherein the weight member is disposed in a recess of the head main body.

16. The iron-type golf club head according to claim 10, wherein the recess is positioned in a sole of the club head forming a bottom face of the club head.

17. The iron-type golf club head according to claim 10, wherein the recess comprises a pair of slant faces that taper toward a bottom surface of the recess and the weight member contacts the slant faces but does not contact the bottom surface so as to form a gap therebetween.

18. The iron-type golf club head according to claim 10, wherein:

the scorelines comprise a toe-most end and a heel-most end; and the weight member further comprises a center of gravity that is located, in the heel-to-toe direction, between the heel-most end and the toe-most end of the scorelines.

19. The iron-type golf club head according to claim 10, further comprising a total head mass, wherein the weight member further comprises a weight member mass that is between 7% and 12% of the total head mass.

* * * * *